US009179723B1

(12) United States Patent
Yoo et al.

(10) Patent No.: US 9,179,723 B1
(45) Date of Patent: Nov. 10, 2015

(54) METHOD OF REFORMING EYELASHES

(71) Applicants: Jee-Young Yoo, Seoul (KR); Sug-Yong Kang, Seoul (KR)

(72) Inventors: Jee-Young Yoo, Seoul (KR); Sug-Yong Kang, Seoul (KR); Ji-Eun Yoo, Seoul (KR)

(73) Assignees: Jee-Young Yoo, Seoul (KR); Sug-Yong Kang, Seoul (KR)

( * ) Notice: Subject to any disclaimer, the term of this patent is extended or adjusted under 35 U.S.C. 154(b) by 0 days.

(21) Appl. No.: 14/528,110

(22) Filed: Oct. 30, 2014

(51) Int. Cl.

| | |
|---|---|
| ***A41G 3/00*** | (2006.01) |
| ***A45D 40/30*** | (2006.01) |
| ***A41G 5/00*** | (2006.01) |
| ***A41G 5/02*** | (2006.01) |

(52) U.S. Cl.
CPC ..... *A41G 5/02* (2013.01)

(58) Field of Classification Search
CPC ..... A41G 5/00; A41G 5/004; A41G 5/0053; A41G 5/008; A41G 5/0086; A41G 5/02
USPC ..... 132/201, 200, 216, 217, 53–56
See application file for complete search history.

(56) References Cited

U.S. PATENT DOCUMENTS

| | | | | |
|---|---|---|---|---|
| 7,600,519 | B2 | 10/2009 | Dinh | |
| 8,113,218 | B2 * | 2/2012 | Nguyen | 132/201 |
| 8,752,562 | B2 * | 6/2014 | Dinh | 132/201 |
| 8,826,919 | B2 * | 9/2014 | Dinh | 132/201 |
| 2007/0023062 | A1 * | 2/2007 | McKinstry et al. | 132/201 |
| 2007/0295352 | A1 * | 12/2007 | Dinh | 132/200 |
| 2012/0145173 | A1 * | 6/2012 | Dinh | 132/200 |
| 2013/0312782 | A1 * | 11/2013 | Kindall | 132/201 |
| 2014/0069449 | A1 * | 3/2014 | Le | 132/201 |
| 2014/0069450 | A1 * | 3/2014 | Le | 132/201 |

* cited by examiner

*Primary Examiner* — Vanitha Elgart
(74) *Attorney, Agent, or Firm* — Revolution IP, PLLC

(57) ABSTRACT

Disclosed is a method of reforming eyelashes. According to the present invention, a method of reforming eyelashes is provided, which is capable of preventing eyelashes from being damaged and pulled out, maintaining an effect of beauty care for a long time, and reducing a cosmetic procedure time.

8 Claims, 20 Drawing Sheets a b

METHOD OF REFORMING EYELASHES

BACKGROUND OF THE INVENTION

1. Field of the Invention

The present invention relates to methods of reforming eyelashes, and more particularly, to a method of reforming eyelashes, which is capable of preventing eyelashes from being damaged and pulled out, maintaining an effect of beauty care for a long time, and reducing a cosmetic procedure time.

2. Background Art

Although women's instinct for beauty is not something that started just yesterday, much attention has recently been paid to body shape management or beauty treatments for looking better.

In particular, among various beauty treatments, a beauty treatment using artificial eyelashes causes flat eyelashes to look longer and thicker by extending the eyelashes by gluing artificial eyelashes thereto, thereby making eyes clear and deep. Thus, the beauty treatment using artificial eyelashes has been recently widely used.

To extend eyelashes using artificial eyelashes, a person who performs a cosmetic procedure glues an artificial eyelash to an eyelash and repeatedly performs this process on the other eyelashes.

However, since Asians generally have straight eyelashes, eyelashes sag down when eyes are closed. Thus, artificial eyelashes are difficult to glue to the eyelashes such that the artificial eyelashes are in contact with a long and wide area of the eyelashes. Also, artificial lashes are likely to be glued to only a portion of the root of the eyelashes. Thus, a gap between the artificial eyelashes and the eyelashes may increase at the top of the eyelashes.

In order to increase an area of the artificial eyelashes to be in contact with the eyelashes, gaps between the artificial eyelashes and the eyelashes should be individually pressed using tweezers or the like. Thus, a work of gluing the artificial lashes is complicated and tricky, thereby increasing a cosmetic procedure time.

When an area of the artificial eyelashes glued to the eyelashes is small to increase a gap therebetween, these eyelashes are likely to be tangled with each other after the cosmetic procedure, thereby aggravating the appearance of the eyelashes. In a worst scenario, eyelashes may be lost due to traction alopecia, thereby causing a permanent hair loss to occur.

When eyelashes are intermittently lost, for example, in a gap-toothed shape, an effect of beauty care is lowered and the cosmetic procedure should be thus performed again.

Accordingly, there is a need to develop a method of reforming eyelashes, which is capable of preventing eyelashes from being damaged or pulled out, enabling an effect of beauty care to last for a long time, and reducing a cosmetic procedure time.

SUMMARY OF THE INVENTION

One or more embodiments of the present invention include a method of reforming eyelashes, which is capable of preventing eyelashes from being damaged or pulled out and enabling an effect of beauty care to last twice or more than in the related art.

One or more embodiments of the present invention also include a method of reforming eyelashes, in which extended eyelashes are prevented from being tangled without causing a feeling of irritation after a cosmetic procedure, thereby enhancing a feeling of wearing and an effect of beauty care.

One or more embodiments of the present invention also include a method of reforming eyelashes, in which artificial eyelashes are glued to the eyelashes of a person who undergoes a cosmetic procedure in a state the eyelashes stand vertically, thereby increasing a length of the artificial eyelashes glued to the eyelashes, easily performing the cosmetic procedure, and reducing a cosmetic procedure time.

One or more embodiments of the present invention also include a method of reforming eyelashes, in which eyelashes are processed by dividing them into layers and artificial eyelashes having different lengths are glued to regions of the eyelashes, thereby performing a customized cosmetic procedure suitable for the eyelashes of a person who undergoes a cosmetic procedure and producing various effects of beauty care.

One or more embodiments of the present invention also include a method of reforming eyelashes, in which a gap-increasing unit is used to easily glue artificial eyelashes and reduce a cosmetic procedure time.

To achieve these objects, the present invention provides a method of reforming eyelashes, the method comprising: adhering lower eyelashes below an eye using at least one tape; adhering all upper eyelashes to an eyelid using the at least one tape; pulling out upper eyelashes, which grow from a mucous membrane of an end of the eyelid to form a base layer, from the at least one tape to stand vertically; gluing artificial eyelashes to the standing upper eyelashes forming the base layer; and pulling out at least some of the other upper eyelashes except for the upper eyelashes forming the base layer from the at least one tape, and gluing the artificial eyelashes to the pulled upper eyelashes.

The method of reforming eyelashes further comprises placing at least one tape on the upper eyelashes, which form the base layer and to which the artificial eyelashes are glued, to be differentiated from the other upper eyelashes.

The gluing of the artificial eyelashes to the other upper eyelashes except for the upper eyelashes forming the base layer comprises pulling out upper eyelashes forming a second layer right above the base layer from the at least one tape and gluing the artificial eyelashes to the pulled upper eyelashes among the other upper eyelashes except for the upper eyelashes forming the base layer.

The gluing of the artificial eyelashes to the other upper eyelashes except for the upper eyelashes forming the base layer further comprises pulling out upper eyelashes forming a third layer right above the second layer from the at least one tape and gluing the artificial eyelashes to the pulled upper eyelashes among the other upper eyelashes except for the upper eyelashes forming the base layer.

When the artificial eyelashes are glued to the upper eyelashes, artificial eyelashes having different lengths are glued to regions of the upper eyelashes.

The artificial eyelashes are glued such that all the upper eyelashes ranging from a root to an upper portion or at least 60% or more of the upper eyelashes are in contact with the artificial eyelashes.

The artificial eyelashes are glued by increasing a gap between a target upper eyelash and an upper eyelash adjacent to the target upper eyelash using a gap-increasing unit and gluing an artificial eyelash to the target upper eyelash.

BRIEF DESCRIPTION OF THE DRAWINGS

FIG. 17*a* is a side view in which a tape is placed on the second-layer upper eyelashes and FIG. 17*b* is a side view in which a tape is placed on the second-layer and the base-layer upper eyelashes;

DETAILED DESCRIPTION

Hereinafter, exemplary embodiments of the present invention will be described in detail with reference to the accompanying drawings. The present invention may, however, be embodied in many different forms and should not be construed as limited to the embodiments set forth herein. Rather, these embodiments are provided so that this disclosure will be thorough and complete, and fully convey the scope of the invention to those skilled in the art. Throughout the specification, the same reference numbers may be used to denote similar components in various embodiments.

Figure 1:
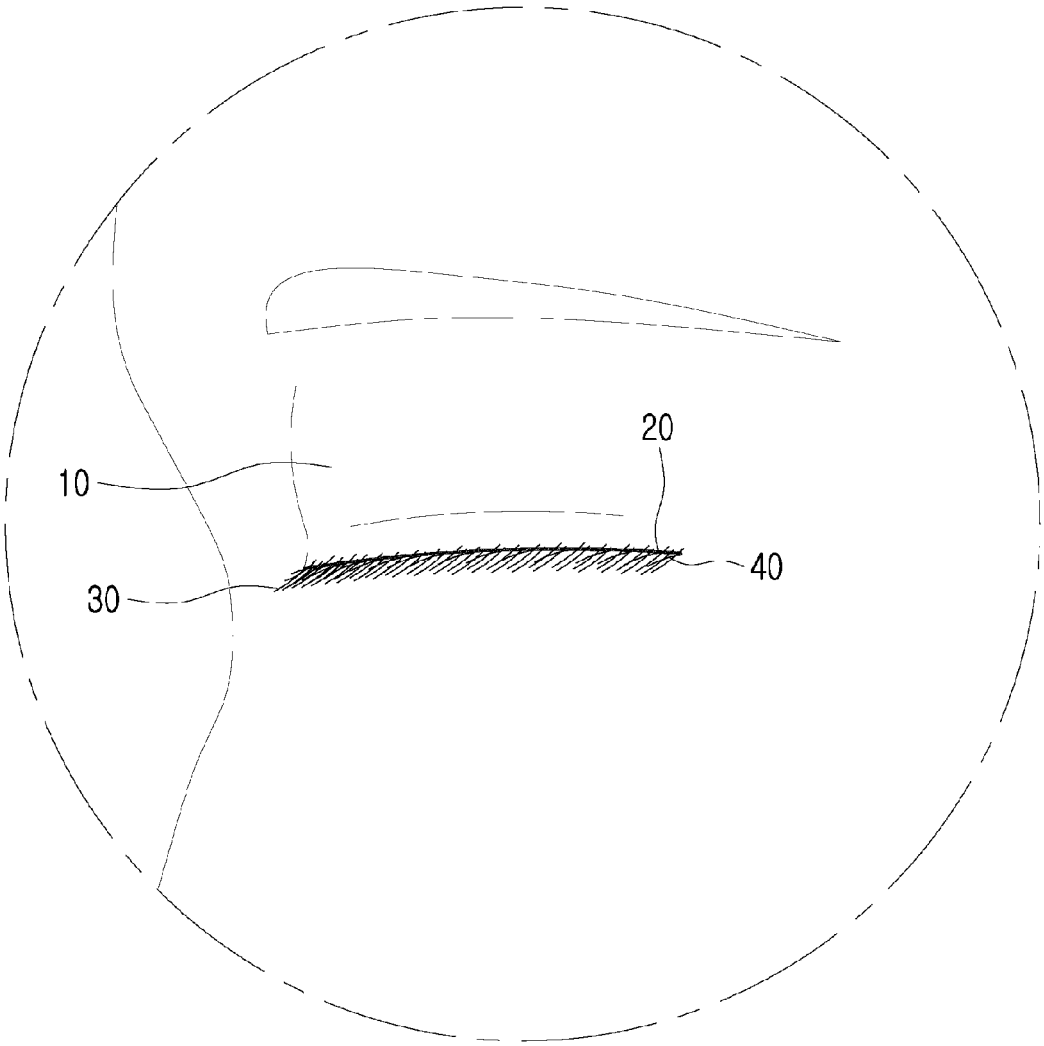
FIGS. 1 and 2 are a plan view and a side view of the upper and lower eyelashes of a person who will undergo a cosmetic procedure when the person's eyes are closed before the cosmetic procedure is performed.
Figure 2:
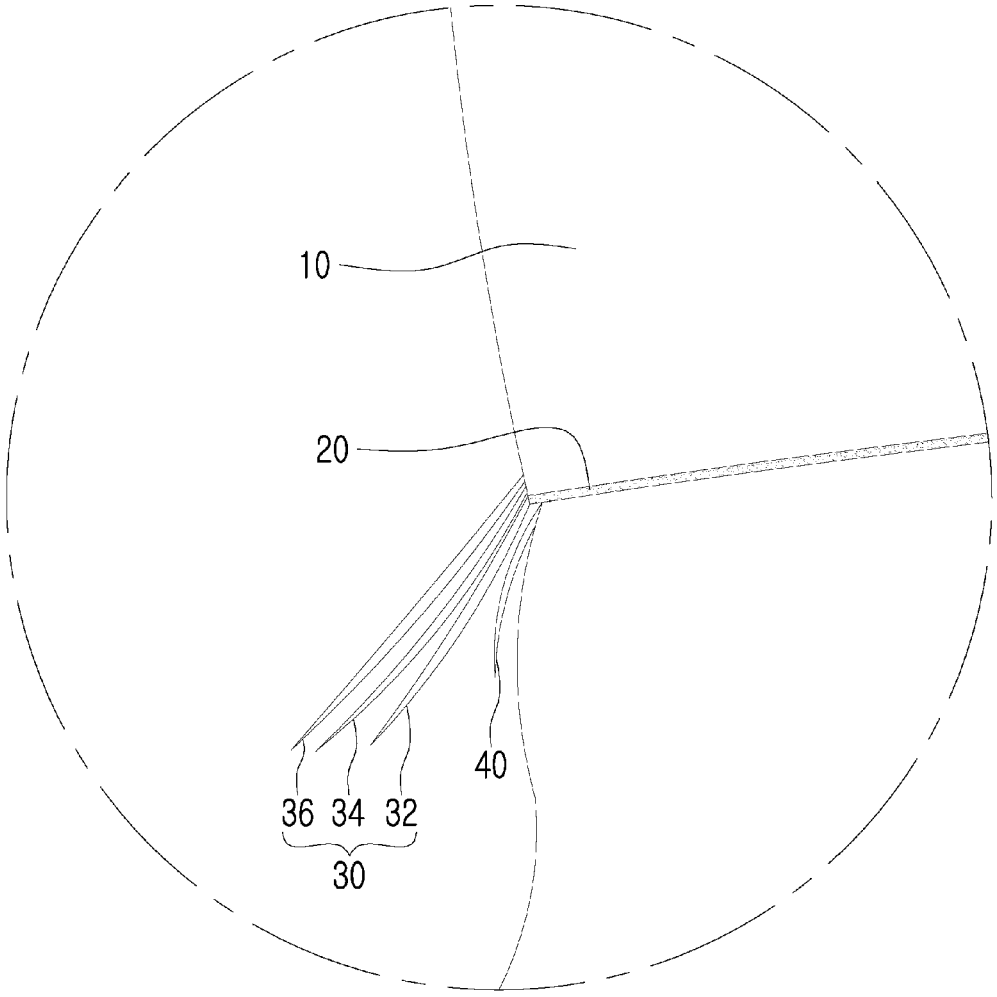
Figure 3:
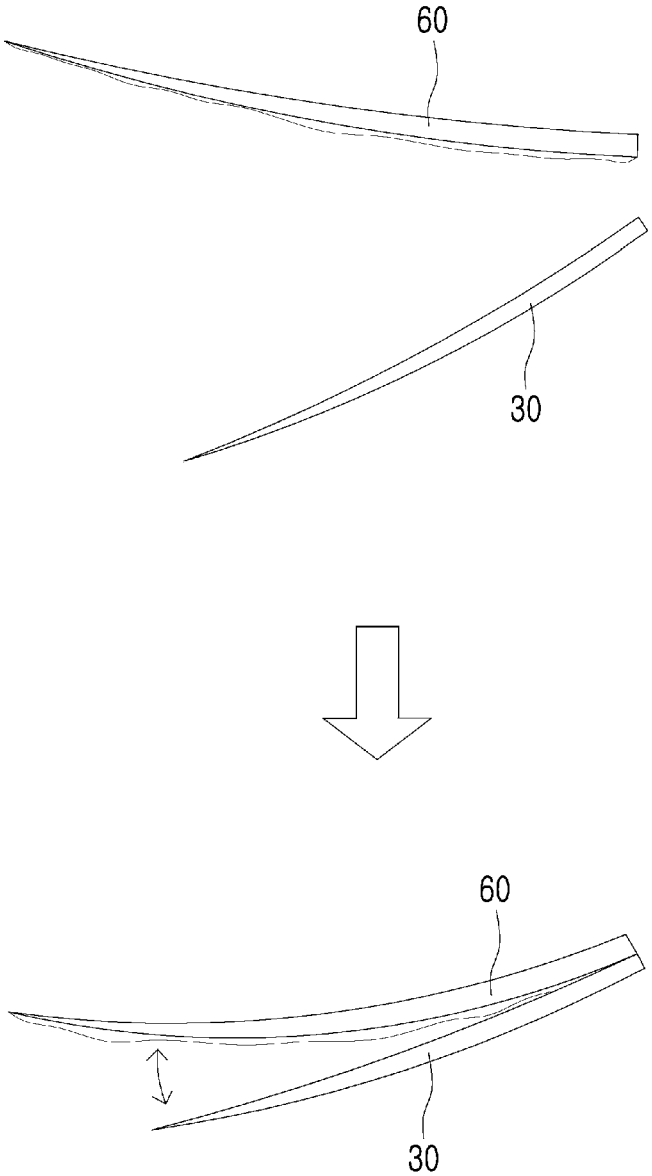
FIG. 3 is a diagram illustrating a case in which artificial eyelashes are glued to only the root of upper eyelashes to cause a gap between the artificial eyelashes and the upper eyelashes.
Figure 4:
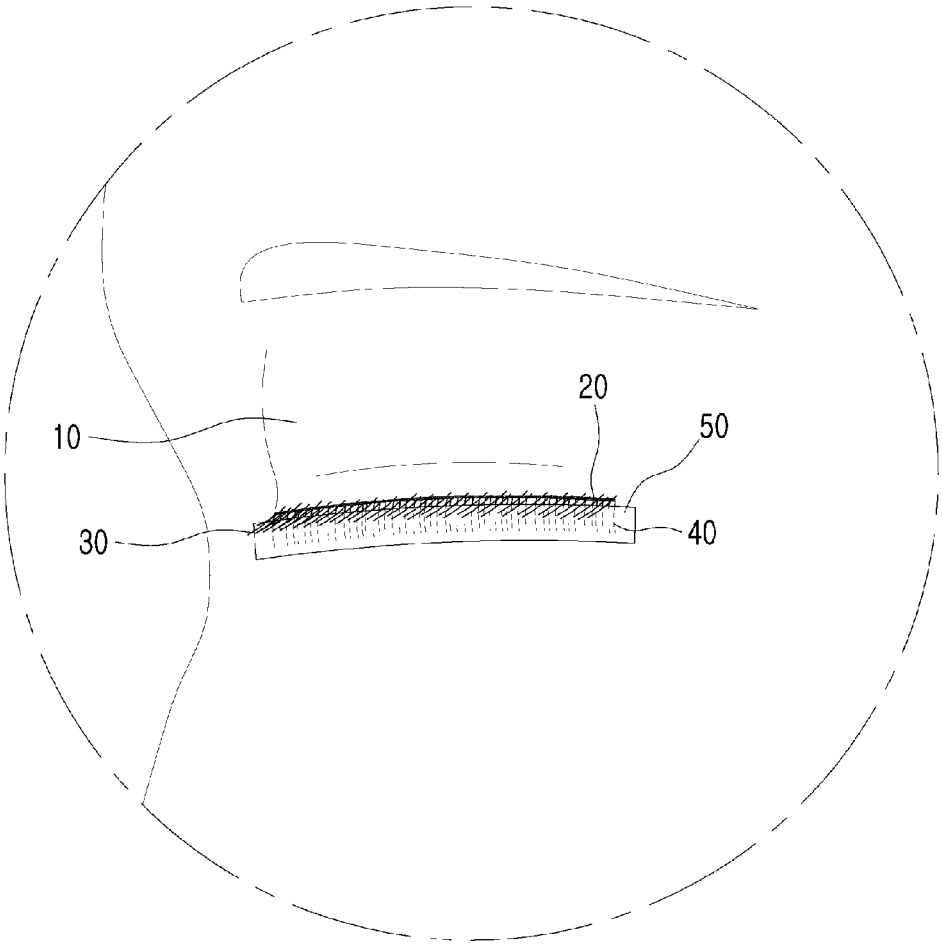
FIGS. 4 and 5 are a plan view and a side view of a state in which lower eyelashes are adhered below the eye of the person who undergoes a cosmetic procedure using a tape.
Figure 5:
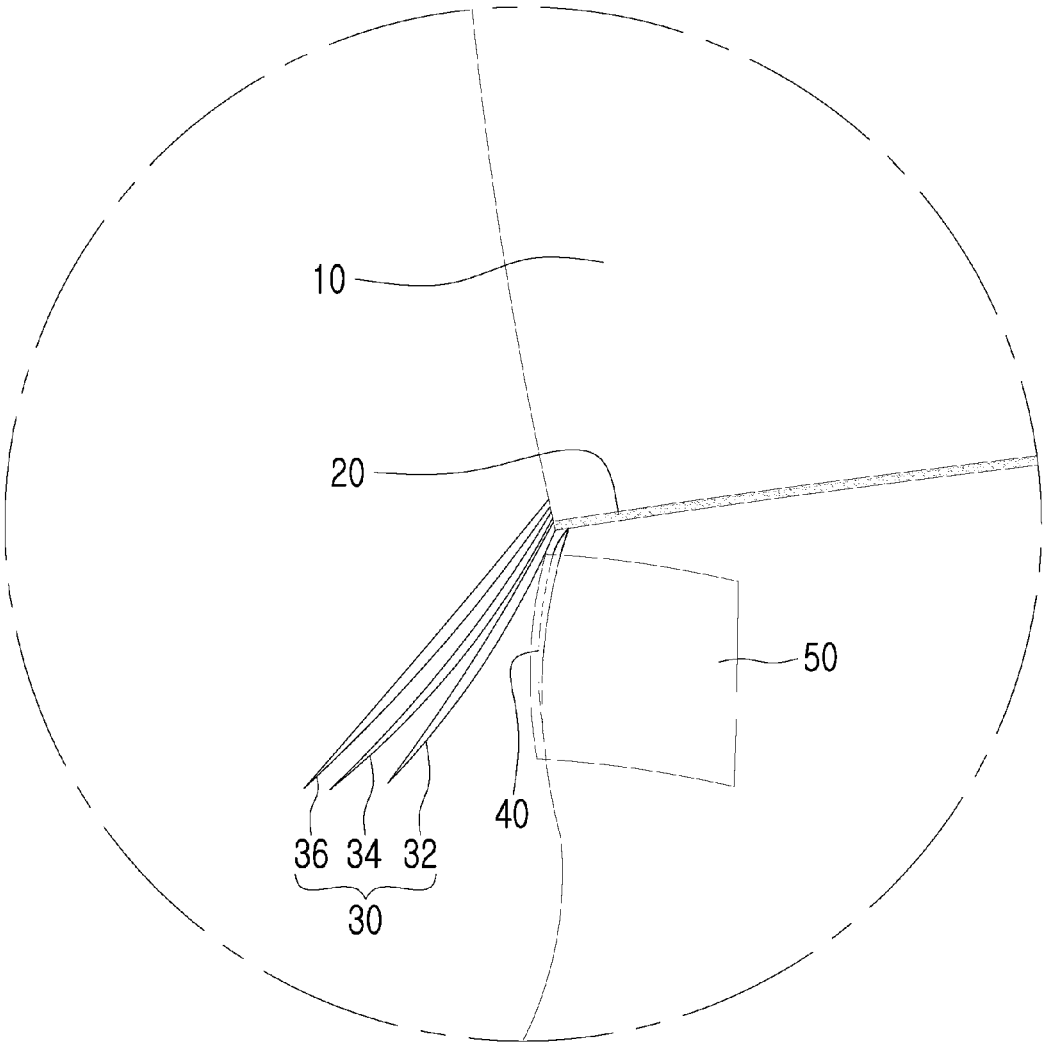
Figure 6:
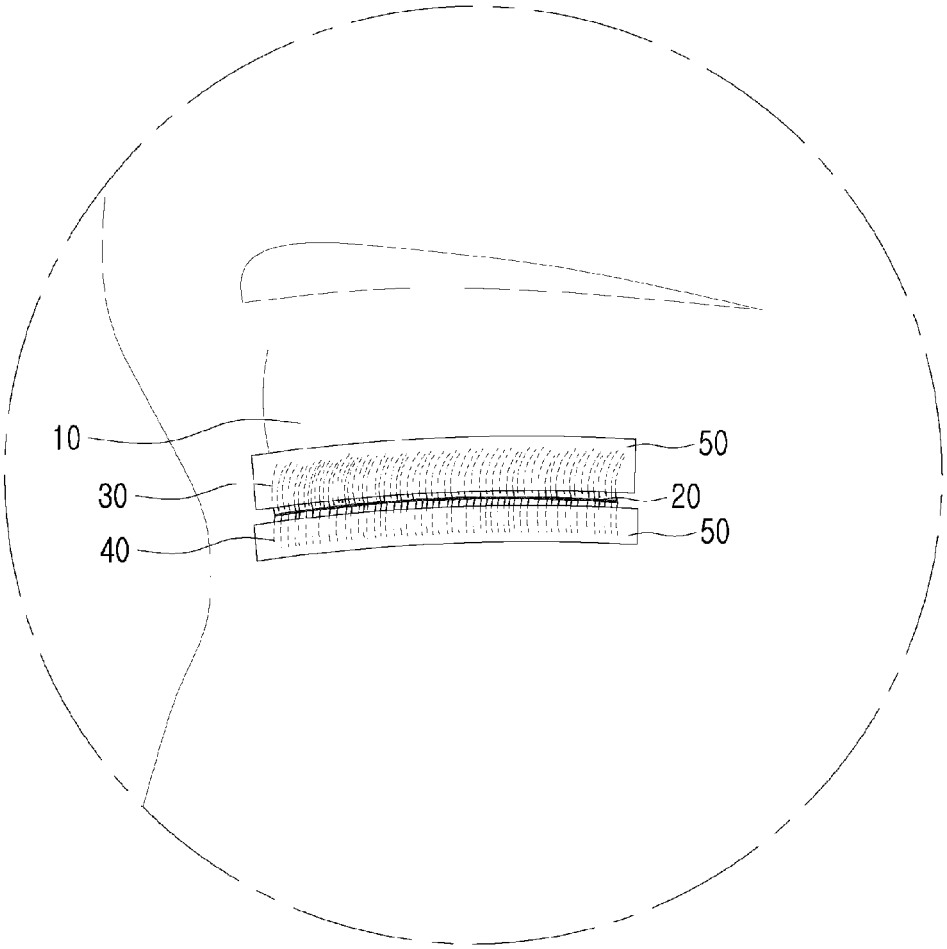
FIGS. 6 and 7 are a plan view and a side view of a state in which upper eyelashes are adhered to an eyelid of the person who undergoes the cosmetic procedure using a tape.
Figure 7:
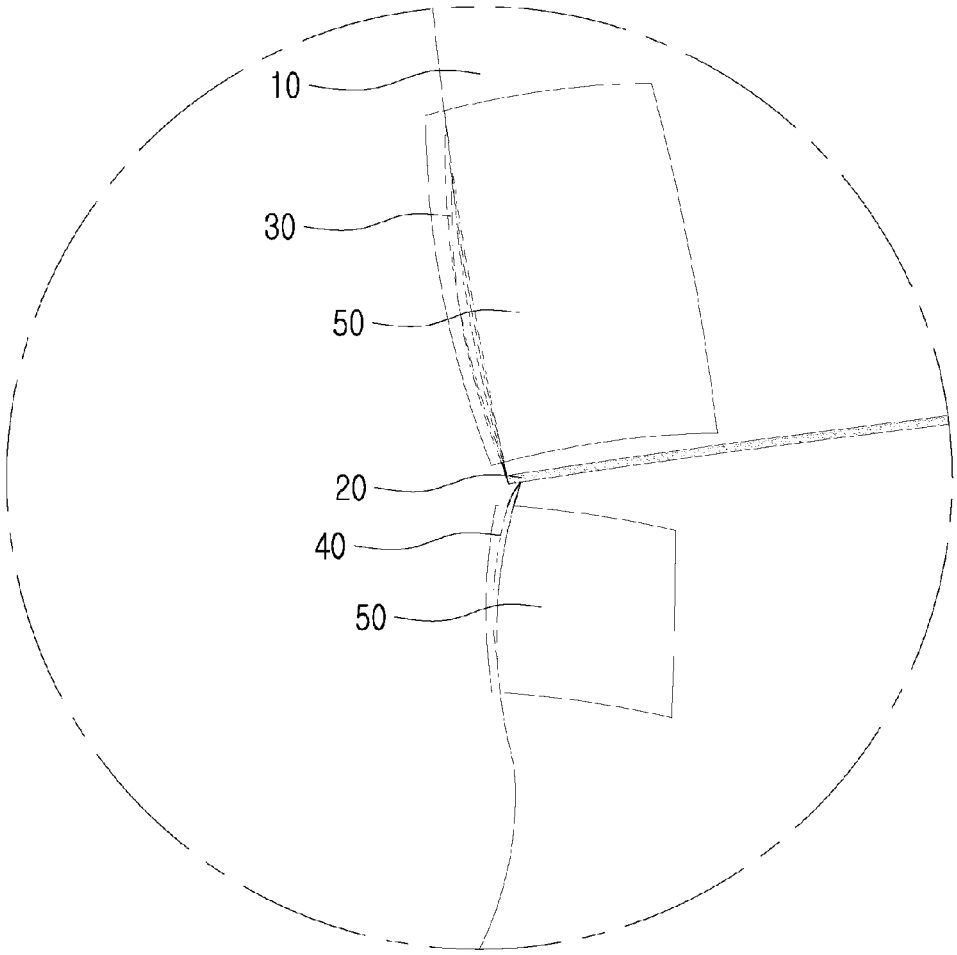
Figure 8:
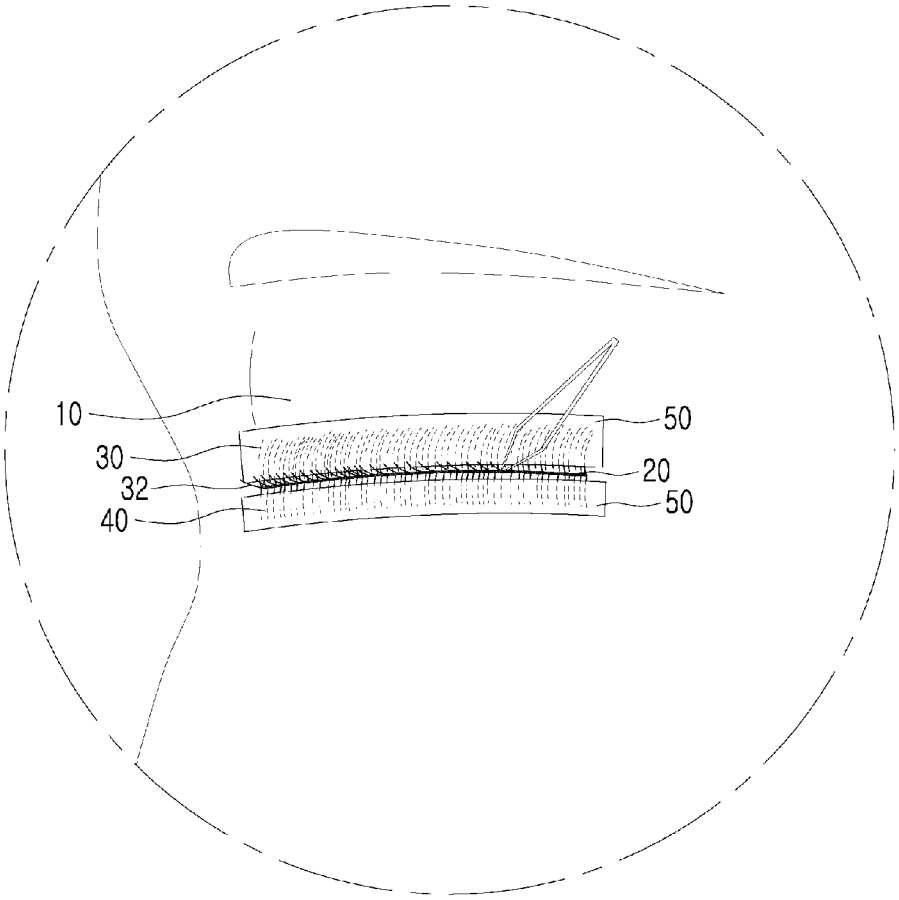
FIGS. 8 and 9 are a plan view and a side view of a state in which upper eyelashes forming a base layer is pulled out to stand vertically among the upper eyelashes adhered to the eyelid.
Figure 9:
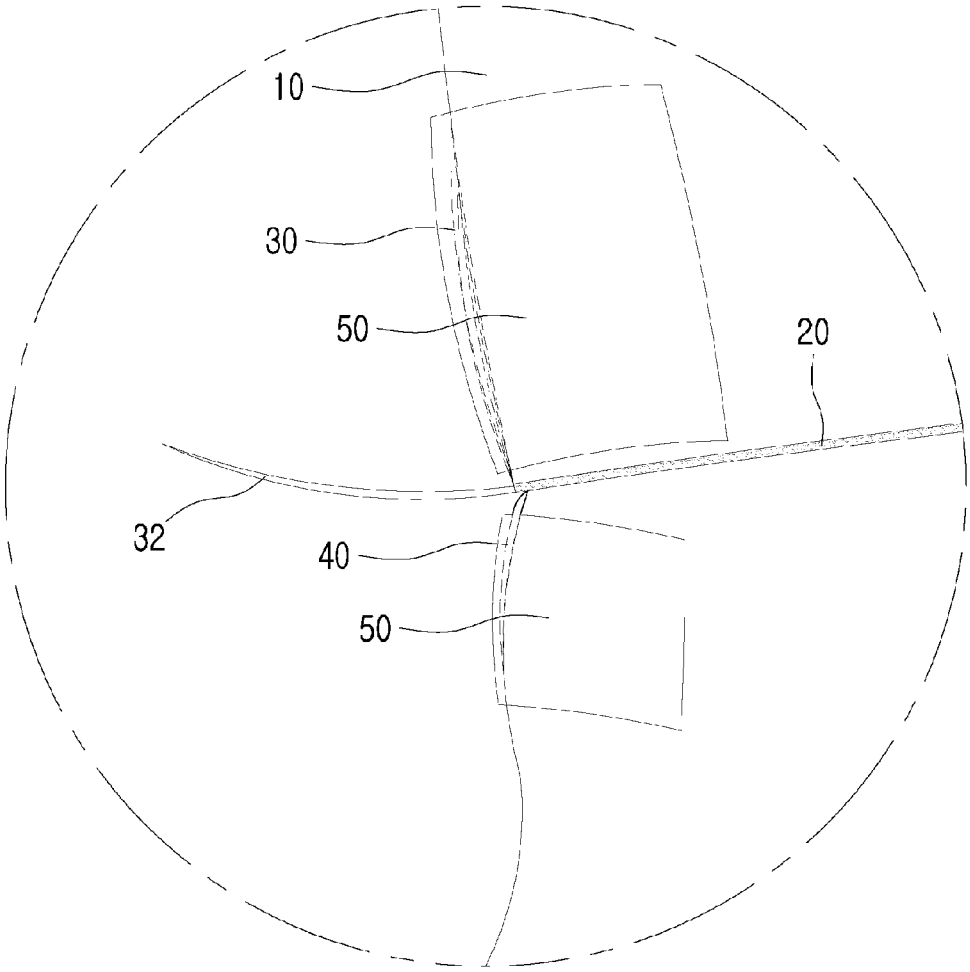
Figure 10:
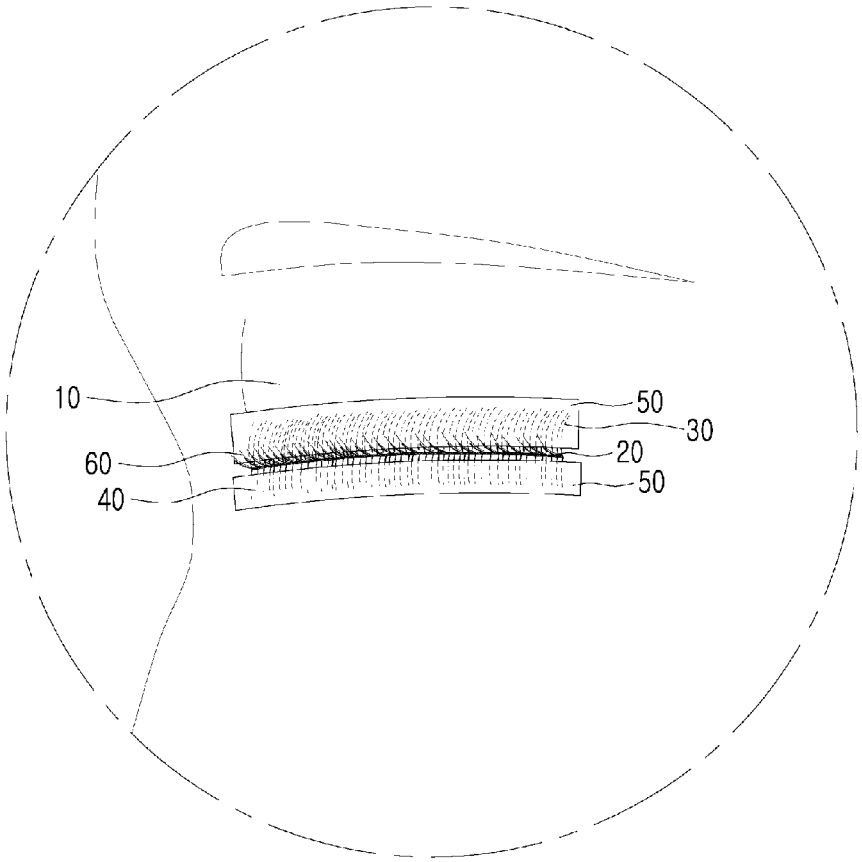
FIGS. 10 and 11 are a plan view and a side view of a process of gluing artificial eyelashes to the standing upper eyelashes forming the base layer.
Figure 11:
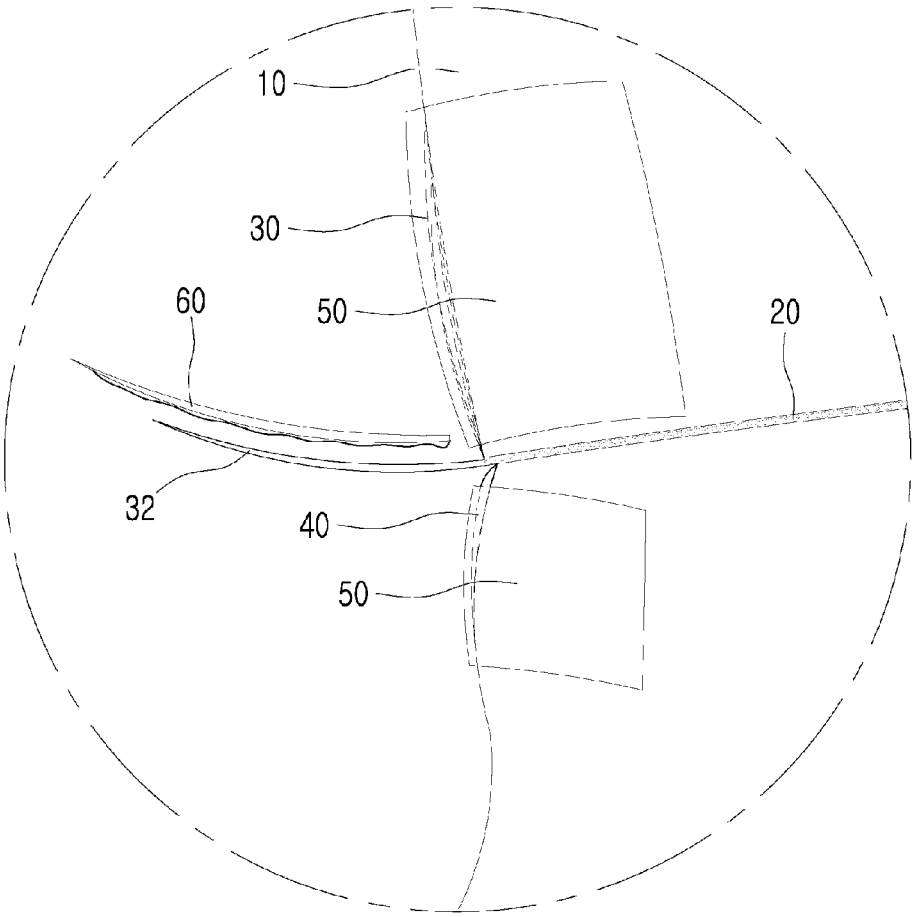
Figure 12:
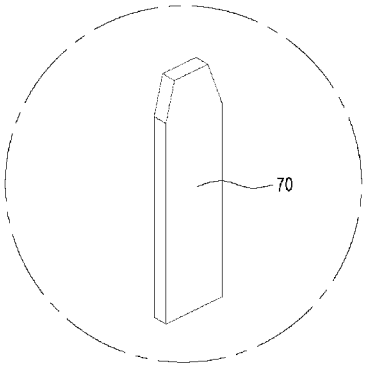
FIG. 12*a* is a perspective view and a plan view of a gap-increasing unit used to glue artificial eyelashes and FIG. 12*b* is a perspective view and a plan view of a process of increasing a gap between adjacent upper eyelashes and processing the eyelashes using the gap-increasing unit.
Figure 12:
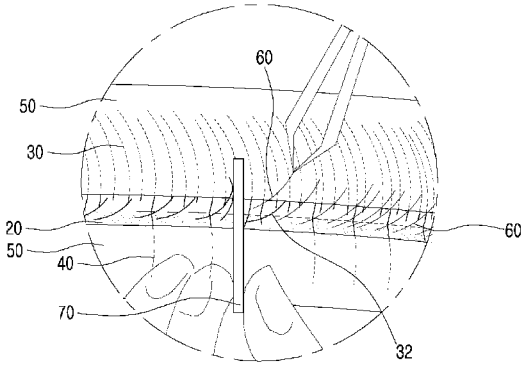
Figure 13:
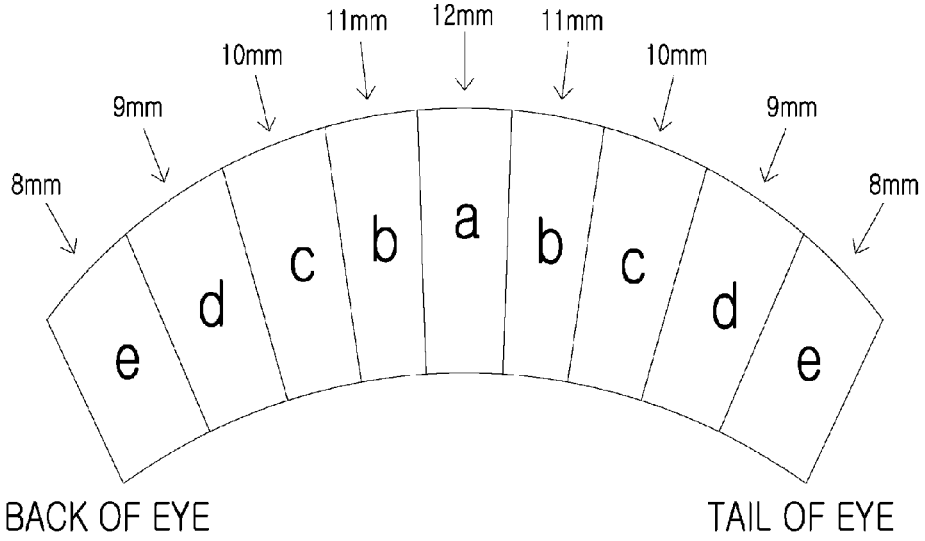
FIG. 13 is a diagram illustrating a case in which eyelashes ranging from the tail of an eye to the back of the eye are divided into several regions and artificial eyelashes having different lengths are glued to the regions of the eyelashes.
Figure 14:
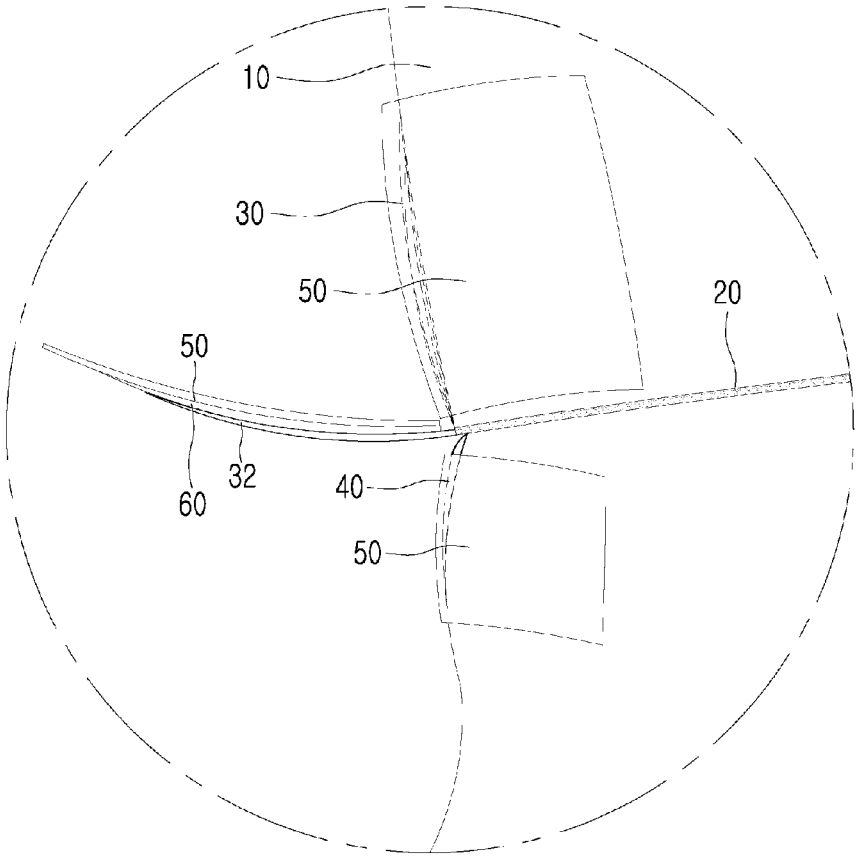
FIG. 14 is a side view of a state in which a tape is placed on upper eyelashes which form a base layer and to which artificial eyelashes are glued to be differentiated from the other upper eyelashes.
Figure 15:
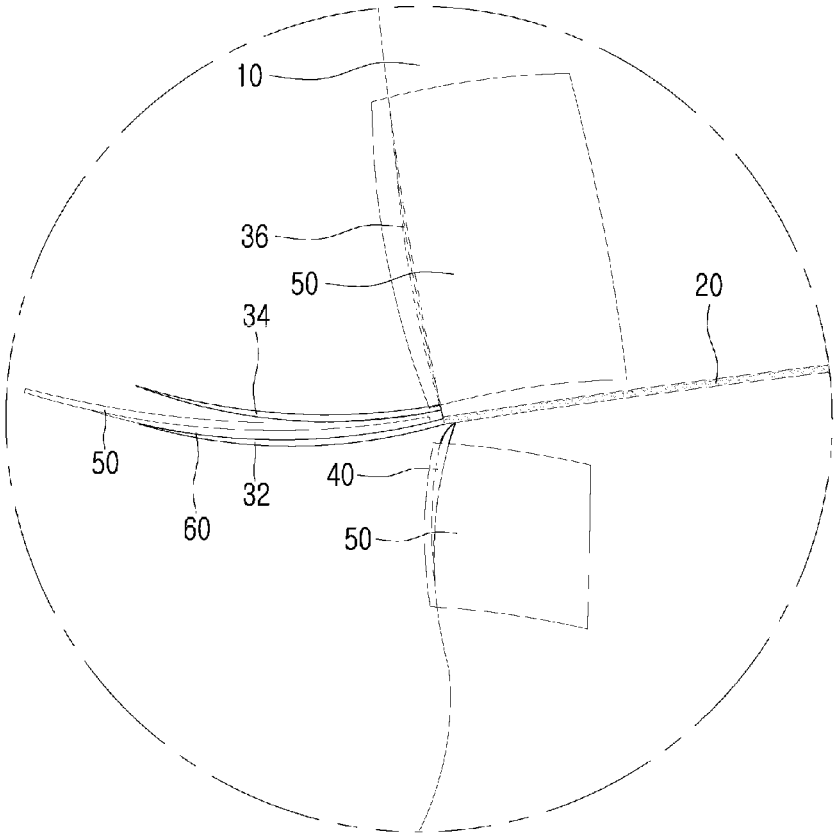
FIG. 15 is a side view of a state in which upper eyelashes forming a second layer are pulled out to stand vertically among the upper eyelashes adhered to the eyelid.
Figure 16:
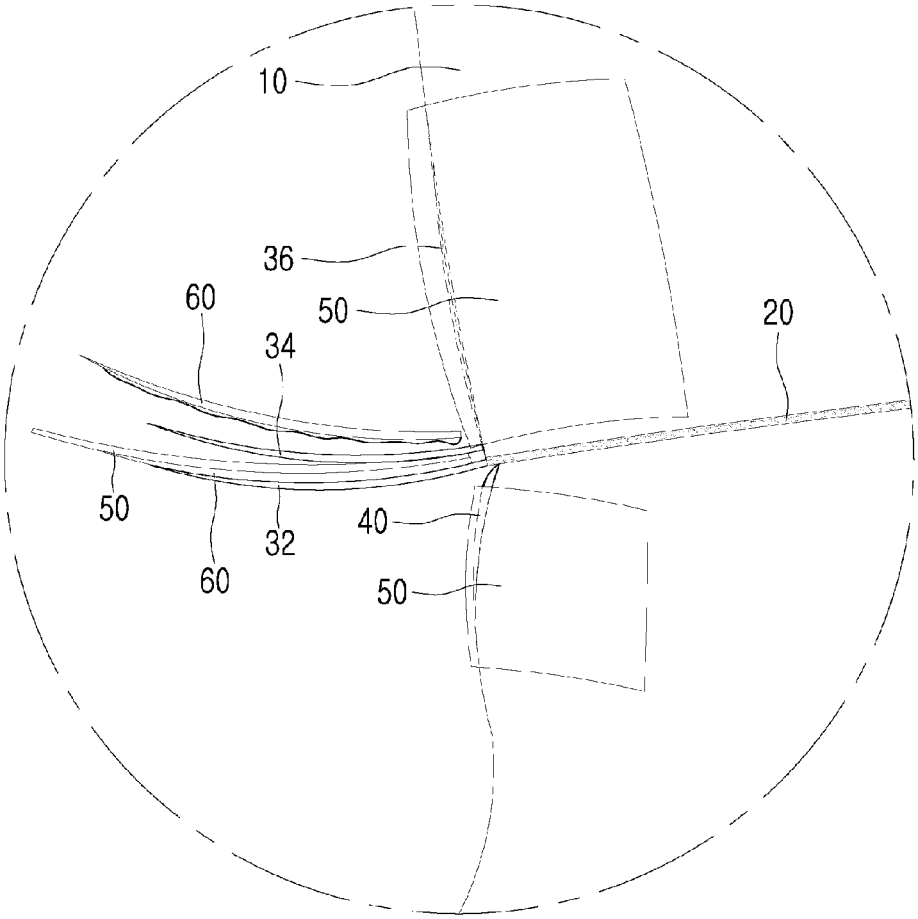
FIG. 16 is a side view of a process of gluing artificial eyelashes to the standing upper eyelashes forming the second layer.
Figure 17:
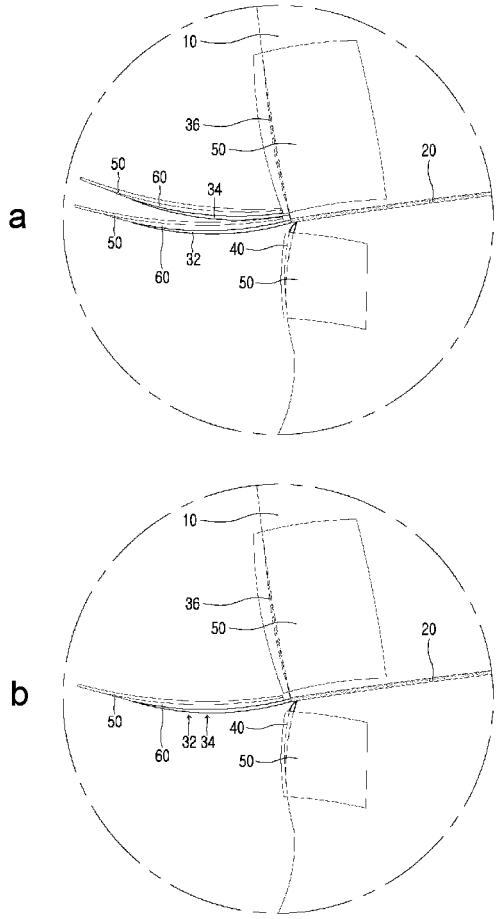
FIG. 17 is a side view of two cases in which a tape is placed on the upper eyelashes which form the second layer and to which the artificial eyelashes are glued to be differentiated from the other upper eyelashes.
Figure 18:
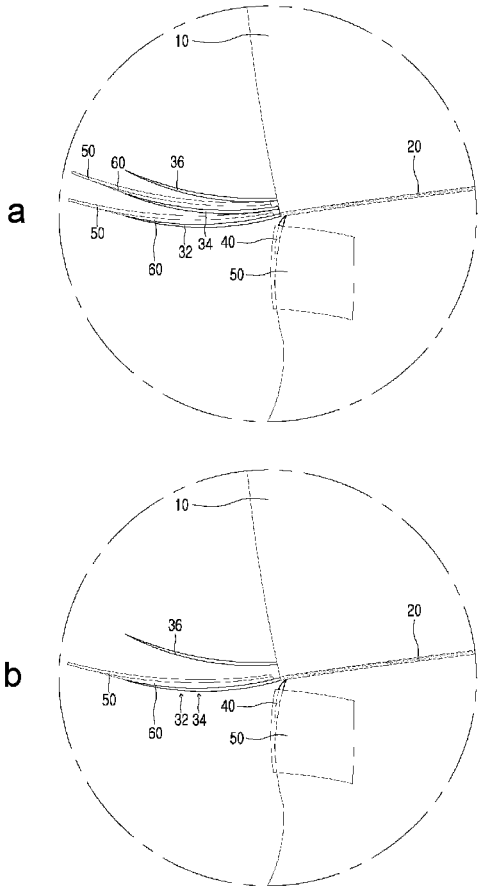
FIG. 18*a* is a side view of a state in which the tape adhered to the eyelid and FIG. 18*b* is a side view in which the tape is removed to cause the other upper eyelashes forming a third layer to stand vertically.
Figure 19:
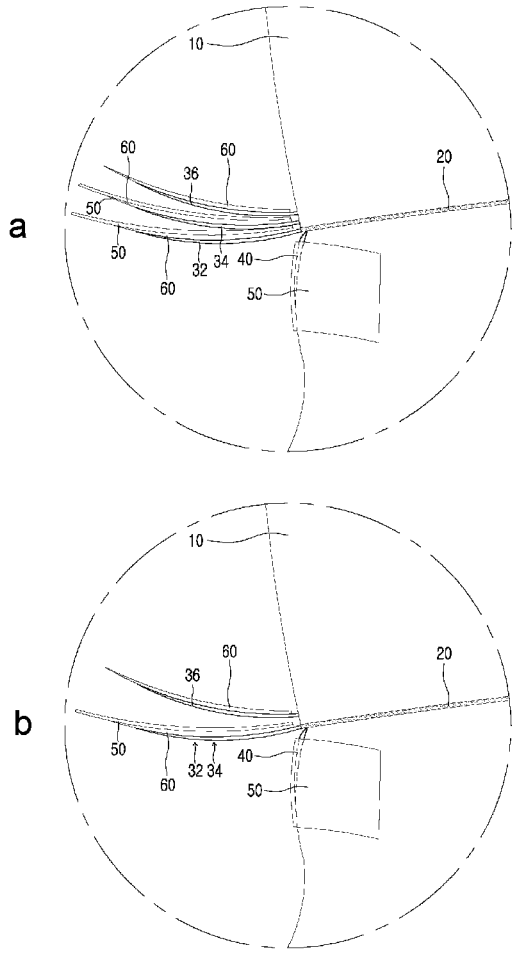
FIG. 19*a* is a side view of a process of gluing artificial eyelashes to the standing upper eyelashes and FIG. 19*b* is a side view of a third layer formed by the processed artificial eyelashes.
Figure 20:
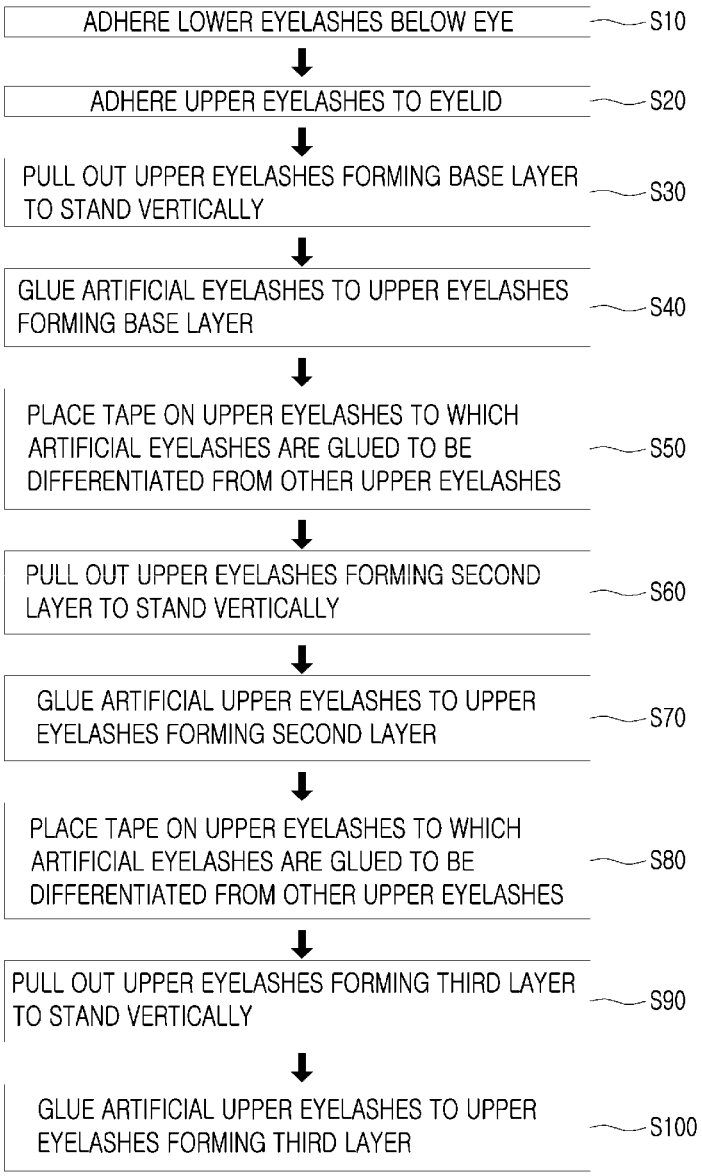
FIG. 20 is a flowchart of a method of reforming eyelashes according to an embodiment of the present invention.

FIGS. 1 and 2 are a plan view and a side view of the upper and lower eyelashes of a person who will undergo a cosmetic procedure when the person's eyes are closed before the cosmetic procedure is performed. FIG. 3 is a diagram illustrating a case in which artificial eyelashes are glued to only the root of upper eyelashes to cause a gap between the artificial eyelashes and the upper eyelashes. FIGS. 4 and 5 are a plan view and a side view of a state in which lower eyelashes are adhered below the eye of the person who undergoes a cosmetic procedure using a tape. FIGS. 6 and 7 are a plan view and a side view of a state in which upper eyelashes are adhered to an eyelid of the person who undergoes the cosmetic procedure using a tape. FIGS. 8 and 9 are a plan view and a side view of a state in which upper eyelashes forming a base layer is pulled out to stand vertically among the upper eyelashes adhered to the eyelid. FIGS. 10 and 11 are a plan view and a side view of a process of gluing artificial eyelashes to the standing upper eyelashes forming the base layer. FIG. 12 is a perspective view and a plan view of a gap-increasing unit used to glue artificial eyelashes and a process of increasing a gap between adjacent upper eyelashes and processing the eyelashes using the gap-increasing unit. FIG. 13 is a diagram illustrating a case in which eyelashes ranging from the tail of an eye to the back of the eye are divided into several regions and artificial eyelashes having different lengths are glued to the regions of the eyelashes. FIG. 14 is a side view of a state in which a tape is placed on upper eyelashes which form a base layer and to which artificial eyelashes are glued to be differentiated from the other upper eyelashes. FIG. 15 is a side view of a state in which upper eyelashes forming a second layer are pulled out to stand vertically among the upper eyelashes adhered to the eyelid. FIG. 16 is a side view of a process of gluing artificial eyelashes to the standing upper eyelashes forming the second layer. FIG. 17 is a side view of two cases in which a tape is placed on the upper eyelashes which form the second layer and to which the artificial eyelashes are glued to be differentiated from the other upper eyelashes. FIG. 18 is a side view of a state in which the tape adhered to the eyelid is removed to cause the other upper eyelashes forming a third layer to stand vertically. FIG. 19 is a side view of a process of gluing artificial eyelashes to the standing upper eyelashes forming third layer. FIG. 20 is a flowchart of a method of reforming eyelashes according to an embodiment of the present invention.

Referring to FIGS. 1 to 20, a method of reforming eyelashes according to an embodiment of the present invention may largely include adhering lower eyelashes 40 below an eye using at least one tape 50, adhering all upper eyelashes 30 to an eyelid using at least one tape 50, pulling out base-layer upper eyelashes 32, which grow from a mucous membrane 20 of an end of the eyelid 10 and form a base layer (hereinafter referred to as "base-layer upper eyelashes"), from the at least one tape 50 to stand vertically, gluing artificial eyelashes 60 to the standing base-layer upper eyelashes 32, pulling out at least some of the remaining upper eyelashes except for base-layer upper eyelashes from the at least one tape 50, and gluing the artificial eyelashes 60 to the standing upper lashes.

First, a person who will undergo a cosmetic procedure closes her eyes in a state in which she lies. Since Asians generally have straight eyelashes as described above, her upper eyelashes 30 sag down when she closes her eyes as illustrated in FIGS. 1 and 2.

When the artificial eyelashes 60 are glued in this state as in the related art, it is difficult to increase a length of the artificial eyelashes 60 to be glued. Thus, the artificial eyelashes 60 are glued to only the root of the upper eyelashes 30 and a gap between the artificial eyelashes 60 and the upper eyelashes 30 thus increases at the top of the upper eyelashes 30 as illustrated in FIG. 3.

A method of reforming eyelashes according to an embodiment of the present invention provides a solution to this problem.

As illustrated in FIGS. 4 and 5, first, all the lower eyelashes 40 are glued below an eye using the at least one tape (operation S10) to trim the lower eyelashes 40 not to interrupt a cosmetic procedure which will be performed thereafter.

Next, as illustrated in FIGS. 6 and 7, all the upper eyelashes 30 are adhered to the eyelid 10 using the at least one tape 50 (operation S20). Although the adhesive properties of the at least one tape 50 are not strong, the at least one tape 50 exhibits an adhesive strength sufficient to cause the upper eyelashes 30 having a property of returning to its original position to stay at the eyelid 10.

After all the upper eyelashes 30 are adhered to the eyelid 10, some of the upper eyelashes 30 are pulled out from the at least one tape 50 to stand vertically using a tool such as tweezers or the like as illustrated in FIGS. 8 and 9 (operation 530). Since the adhesive strength of the at least one tape 50 is not strong as described above, it is not a difficult work to remove the upper eyelashes 30 glued between the at least one tape 50 and the eyelid 10.

The upper eyelashes 30 removed from between the at least one tape 50 and the eyelid 10 stand vertically upward without sagging down due to the inertia applied thereto when the upper eyelashes 30 were adhered to the eyelid 10, i.e., to an upper portion of the eyelid 10. Since the person who undergoes the cosmetic procedure is lying, the upper eyelashes 30 face right upward. In this state, a person who performs the cosmetic procedure is able to easily glue the artificial eyelashes 60 to the upper eyelashes 30 such that a long and wide area of the artificial eyelashes 60 is in contact with the upper eyelashes 30.

Here, the upper eyelashes 30 need not be glued to the eyelid 10 for a long time so as to stand the upper eyelashes 30 upward. Even if the upper eyelashes 30 are removed within a short time after they are adhered to the eyelid 10, the upper eyelashes 30 may continuously stand upward.

As illustrated in FIGS. 10 and 11, when the artificial eyelashes 60 are glued to the upper eyelashes 30 such that a wide area of the artificial eyelashes 60 is in contact with the upper eyelashes 30 while the cosmetic procedure is performed in a state in which the upper eyelashes 30 stand vertically, a gap between the artificial eyelashes 60 and the upper eyelashes 30 may be minimized. Thus, it is possible to prevent eyelashes from being tangled with each other and traction alopecia from occurring. Also, since the artificial eyelashes 60 may be glued to the upper eyelashes 30 for a long time, an effect of beauty care may be maintained for a long time. Furthermore, a feeling of irritation may be prevented while the artificial eyelashes 60 are glued to the upper eyelashes 30, thereby enhancing an effect of wearing the artificial eyelashes 60.

In this case, the artificial eyelashes 60 may be glued to be in contact with all the base-layer upper eyelashes 32 ranging from roots to upper portions or at least 60% or more of the base-layer upper eyelashes 32, based on a long cosmetic procedure experience-based fact that eyelashes are not tangled with each other or traction alopecia does not occur when at least 60% or more of the upper eyelashes 30 are glued to the artificial eyelashes 60 to be in contact with the artificial eyelashes 60.

In a method of reforming eyelashes according to an embodiment of the present invention, the upper eyelashes 30 are united with the artificial eyelashes 60 to maximize an interface between the upper eyelashes 30 and the artificial eyelashes 60. However, an effect of a cosmetic procedure obtained in this case may be also obtained even when the artificial eyelashes 60 are glued to at least 60% or more of the upper eyelashes 30.

The base-layer upper eyelashes 32 among the upper 20 eyelashes 30 are pulled out from the at least one tape 50 as described above. The upper eyelashes 30 of a human do not grow in a line but usually grow in a predetermined number of layers. In general, the upper eyelashes 30 grow from the mucous membrane 20 of the end of the eyelid 10 to form a base layer (first layer), a second layer, and a third layer. For some persons, the upper eyelashes 30 may grow in four layers toward the tail of an eye.

In the method of reforming eyelashes according to an embodiment of the present invention, the base-layer upper eyelashes 32 among the upper eyelashes 30 growing in several lines are first pulled out to glue the artificial eyelashes 60 thereto, rather than randomly performing the cosmetic procedure on the upper eyelashes 30 without dividing the upper eyelashes 30 into upper and lower lines as in the related art (operation S40).

As described above, when the artificial eyelashes 60 are glued to the base-layer upper eyelashes 32 and are then sequentially glued to the remaining upper eyelashes 30 belonging to the other layers, a natural look may be produced while preventing eyelashes from being tangled after the cosmetic procedure.

Since the cosmetic procedure is performed based on the base layer, the artificial eyelashes 60 having various lengths and curls may be applied to the second and third layers to produce various looks, thereby providing a customized cosmetic procedure satisfying a customer's need.

As illustrated in FIG. 12, a gap between an upper eyelash 30 which is a target upper eyelash and an upper eyelash 30 adjacent to the target upper eyelash 30 may be increased using a gap-increasing unit 70, and one of the artificial eyelashes 60 may be glued to the target upper eyelash 30.

The gap-increasing unit 70 may have a bar shape having a predetermined length as illustrated in FIG. 12. When such a bar-type member is used as the gap-increasing unit 70, a curtain effect that reliably differentiates the target upper eyelash 30 from the adjacent upper eyelash 30 may be obtained to enable a person who performs the cosmetic procedure to focus on the target upper eyelash 30, thereby increasing a working efficiency and preventing a negligent accident from occurring.

Thus, the gap-increasing unit 70 which is a bar-type plate as illustrated in FIG. 12 may be used rather than a slender rod such as a toothpick or tweezers.

When the artificial eyelash 60 is glued to the target upper eyelash 30 after the gap between the adjacent upper eyelashes 30 is increased using the gap-increasing unit 70, the gluing of the artificial eyelash 60 is not interrupted by the adjacent upper eyelash 30 to reduce a working time and precisely glue the artificial eyelash 60 to the target upper eyelash 30, thereby increasing the precision and efficiency of the work.

When the artificial eyelashes 60 are glued to the base-layer upper eyelashes 32, the artificial eyelashes 60 having different lengths may be glued to regions of the base-layer upper eyelashes 32. That is, the base-layer upper eyelashes 32 ranging from the tail of an eye to the back of the eye may be divided into several regions, relatively long artificial eyelashes 60 may be glued to a middle region, and relatively short artificial eyelashes 60 may be glued to the tail and back of the eye.

The lengths of artificial eyelashes that are on the market range from 5 mm to 19 mm, and are different by 1 mm. Among these artificial eyelashes, artificial eyelashes having lengths of 8 mm to 12 mm have been frequently used. Thus, when the artificial eyelashes having lengths of 8 mm to 12 mm are used as the artificial eyelashes 60, upper eyelashes may be divided into several regions and the artificial eyelashes 60 having different lengths may be applied to the regions of the eyelashes as illustrated in FIG. 13.

For example, a 12 mm artificial eyelash 60 may be glued to a region a which is a middle region of the upper eyelashes, 11 mm artificial eyelashes 60 may be glued to regions b adjacent both sides of the region a, 10 mm artificial eyelashes 60 may be glued to regions c, 9 mm artificial eyelashes 60 may be glued to regions d, and 8 mm artificial eyelashes 60 may be glued to regions e corresponding to the tail and back of an eye.

However, the present invention is not limited by the above embodiment, and the number of regions into which upper eyelashes are divided and the lengths of the artificial eyelashes 60 to be applied to the regions may vary according to the size of the eyes of a person who will undergo the cosmetic procedure, the lengths of the eyelashes of the person, whether the eyelashes of the person are thick or not, etc.

As described above, eyelashes may be divided into several regions and the artificial eyelashes 60 having different lengths may be glued to the regions of the eyelashes to produce natural eyelashes having a crescent shape, rather than uniformly applying artificial eyelashes having the same lengths. Thus, an effect of beauty care may be enhanced to produce a more natural look. Furthermore, artificial eyelashes 60 having various curls may be used to produce various looks.

In the related art, the upper eyelashes 30 are arbitrarily, that is, randomly, divided using the at least one tape 50 and the artificial eyelashes 60 are glued to the upper eyelashes 30. Thus, the artificial eyelashes 60 having different lengths cannot be naturally glued to regions of the upper eyelashes 30 as suggested in the present invention.

However, according to an embodiment of the present invention, the upper eyelashes 30 may be processed by dividing them into different layers according to the location of the root of the upper eyelashes 30 and applying the artificial eyelashes 60 having different lengths to regions of the upper eyelashes 30. Thus, an effect of more natural beauty may be produced and a working efficiency is improved, compared to the related art.

After the gluing of the artificial eyelashes 60 to the base-layer upper eyelashes 32 is completed, the at least one tape 50 is placed on the processed base-layer upper eyelashes 32 as illustrated in FIG. 14 (operation S50). The at least one tape 50 is used to differentiate the processed base-layer upper eyelashes 32 from the remaining upper eyelashes 30 (which will be processed thereafter) not to be mixed with the remaining upper eyelashes 30. The at least one tape 50 may be used to differentiate the processed upper eyelashes 30 from non-processed upper eyelashes 30, similar to a bookmark.

The at least one tape 50 has adhesive properties. Thus, the processed base-layer upper eyelashes 32 may be maintained in a fixed state by simply placing the at least one tape 50 thereon.

Then, as illustrated in FIG. 15, upper eyelashes 34 forming a second layer right above the base layer (hereinafter referred to as 'second-layer upper eyelashes') are pulled out from the at least one tape 50 to stand vertically (operation S60).

The second-layer upper eyelashes 34 stand vertically upward without sagging down below the eye of the person, due to inertia applied thereto when the second-layer upper eyelashes 34 are adhered upward, similar to the base-layer upper eyelashes 32. That is, since the person who undergoes the cosmetic procedure is lying, the second-layer upper eyelashes 34 face right upward.

Then, as illustrated in FIG. 16, the artificial eyelashes 60 are glued to the standing second-layer upper eyelashes 34 (operation S70). Since the second-layer upper eyelashes 34 stand vertically upward, a person who performs the cosmetic procedure may easily glue the artificial eyelashes 60 to the second-layer upper eyelashes 34 such that a long and wide area of the artificial eyelashes 60 is in contact with the second-layer upper eyelashes 34.

Similarly, in this case, the gap-increasing unit 70 described above with reference to FIG. 12 may be used, and the artificial eyelashes 60 having different lengths or various curls may be applied to regions of the second-layer upper eyelashes 34 as described above with reference to FIG. 13, thereby producing various looks.

After the artificial eyelashes 60 are glued to the second-layer upper eyelashes 34, the cosmetic procedure may be completed. In this case, since the cosmetic procedure is generally performed on about 60% of the upper eyelashes 30, the cosmetic procedure may be also referred to as a '60% cosmetic procedure'.

If a person who undergoes the cosmetic procedure wants to make clear eyes, the cosmetic procedure may be additionally performed on the remaining upper eyelashes 36 forming a third layer (hereinafter referred to as 'third-layer upper eyelashes').

Specifically, the at least one tape 50 is placed on the processed second-layer upper eyelashes 34 (operation S80). In this case, one of the following two methods is applicable.

In the first method, as illustrated in FIG. 17*a*, another tape 50 is placed on the processed second-layer upper eyelashes 34 to be individually differentiated from each other in a state in which the at least one tape 50 is continuously placed on the processed base-layer upper eyelashes 32.

In the second method, as illustrated in FIG. 17*b*, the at least one tape 50 placed on the base-layer upper eyelashes 32 is temporarily removed, the processed second-layer upper eyelashes 34 and the processed base-layer upper eyelashes 32 are put together, and the at least one tape 50 is placed again on the processed second-layer upper eyelashes 34 and the processed base-layer upper eyelashes 32.

Any of the two methods may be employed. Thereafter, as illustrated in FIG. 18, the remaining tape 50 adhered to the eyelid 10 is removed to stand all the remaining third-layer upper eyelashes 36 vertically (operation S90), and the gluing of the artificial eyelashes 60 is completed as illustrated in FIG. 19 (operation S100).

In this case, since the cosmetic procedure is generally performed on all the upper eyelashes 30, the cosmetic procedure may be also referred to as a '100% cosmetic procedure'. For some persons, eyelashes may grow at both sides in four lines. However, in most cases, the cosmetic procedure is applied to about 100% of the upper eyelashes 30 when the base-layer upper eyelashes 32 to the third-layer upper eyelashes 36 are processed.

Similarly, the gap-increasing unit 70 may be used and the artificial eyelashes 60 having different lengths or various curls may be glued to the regions of the third-layer upper eyelashes 36 when the third-layer upper eyelashes 36 are processed, thereby producing various looks.

As described above, in a method of reforming eyelashes according to the one or more of the above embodiments of the present invention, eyelashes may be prevented from being damaged or pulled out, an effect of beauty care may be maintained to last twice or more than in the related art, and extended eyelashes may be prevented from being tangled after a cosmetic procedure without causing a feeling of irritation. Accordingly, a feeling of wearing and an effect of beauty care can be enhanced.

Also, artificial eyelashes are glued to the eyelashes of a person who undergoes a cosmetic procedure in which the eyelashes stand vertically to increase a length of the artificial eyelashes to be glued to the eyelashes, easily perform the cosmetic procedure, and reduce a cosmetic procedure time. Also, the artificial eyelashes are glued to the eyelashes by dividing the eyelashes in several layers, thereby performing a customized cosmetic procedure suitable for the eyelashes of the person who undergoes the cosmetic procedure and producing various looks.

Also, a gap-increasing unit is used to easily glue artificial eyelashes to eyelashes and reduce a cosmetic procedure time.

One or more embodiments of the present invention include a method of reforming eyelashes, which is capable or preventing eyelashes from being damaged or pulled out and maintaining an effect of beauty care to last twice or more than in the related art.

One or more embodiments of the present invention also include a method of reforming eyelashes, in which extended eyelashes are prevented from being tangled with each other without causing a feeling of irritation after a cosmetic procedure, thereby enhancing a feeling of wearing and an effect of beauty care.

One or more embodiments of the present invention also include a method of reforming eyelashes, in which artificial eyelashes are glued to the eyelashes of a person who undergoes a cosmetic procedure in a state the eyelashes are pulled up vertically, thereby increasing a length of the artificial eyelashes to be glued to the eyelashes, easily performing the cosmetic procedure, and reducing a cosmetic procedure time.

One or more embodiments of the present invention also include a method of reforming eyelashes, in which eyelashes are processed by diving them into layers and artificial eyelashes having different lengths are glued to regions of the eyelashes, thereby performing a customized cosmetic procedure suitable for the eyelashes of a person who undergoes a cosmetic procedure and producing various effects of beauty care.

Furthermore, a gap-increasing unit is used to easily glue artificial eyelashes to eyelashes and to reduce a cosmetic procedure time.

The present invention has been described with reference to the exemplary embodiments of the present invention, and it would be understood by those skilled in the art that various changes and modifications may be made without departing from the technical conception and essential features of the present invention. Thus, it is clear that all modifications are included in the technical scope of the present invention as long as they include the components as claimed in the claims of the present invention.

What is claimed is:

1. A method of reforming eyelashes, the method comprising:

adhering lower eyelashes below an eye using a first tape;

adhering upper eyelashes to an eyelid using a second tape, wherein the upper eyelashes include base-layer upper eyelashes, second-layer upper eyelashes, and third-layer upper eyelashes, and arranged vertically based on a root location of the upper eyelashes;

pulling out the base-layer upper eyelashes formed at an end of the eyelid from the second tape to stand vertically;

gluing base-layer artificial eyelashes to the standing base-layer upper eyelashes; and pulling out the second-layer upper eyelashes formed above the base-layer upper eyelashes from the second tape to stand vertically;

gluing second-layer artificial eyelashes to the standing second-layer upper eyelashes;

pulling out the third-layer upper eyelashes formed above the second-layer upper eyelashes from the second tape to stand vertically; and gluing third-layer artificial eyelashes to the standing third-layer upper eyelashes;

wherein, when each of the artificial eyelashes is glued to the upper eyelashes, each of the artificial eyelashes has different lengths based on horizontally divided regions of the upper eyelashes.

2. The method of claim 1, further comprising placing a third tape on the glued base-layer artificial eyelashes in order to differentiate from the second-layer and third-layer eyelashes.

3. The method of claim 1, wherein each of the artificial eyelashes is glued such that all the upper eyelashes ranging from the root to an upper portion or at least 60% or more of the upper eyelashes are in contact with each of the artificial eyelashes.

4. The method of claim 1, wherein each of the artificial eyelashes is glued by increasing a gap between a target upper eyelash and an upper eyelash adjacent to the target upper eyelash using a gap-increasing unit and gluing an artificial eyelash to the target upper eyelash.

5. The method of claim 1, wherein each of the gluing steps is performed sequentially based on the base-layer, second-layer, and third-layer eyelashes to prevent the upper eyelashes being tangled.

6. The method of claim 2, further comprising placing a fourth tape on the glued second-layer artificial eyelashes in order to differentiate from the third-layer eyelashes.

7. The method of claim 1, wherein each of the pulling steps is performed sequentially based on the base-layer, second-layer, and third-layer eyelashes to prevent the upper eyelashes being tangled.

8. A method of reforming eyelashes, the method comprising:

adhering lower eyelashes below an eye using a first tape;

adhering upper eyelashes to an eyelid using a second tape, wherein the upper eyelashes include base-layer upper eyelashes, second-layer upper eyelashes, and third-layer upper eyelashes, and arranged vertically based on a root location of the upper eyelashes;

pulling out the base-layer upper eyelashes formed at an end of the eyelid from the second tape to stand vertically;

gluing base-layer artificial eyelashes to the standing base-layer upper eyelashes; and pulling out the second-layer upper eyelashes formed above the base-layer upper eyelashes from the second tape to stand vertically;

gluing second-layer artificial eyelashes to the standing second-layer upper eyelashes;

pulling out the third-layer upper eyelashes formed above the second-layer upper eyelashes from the second tape to stand vertically; and gluing third-layer artificial eyelashes to the standing third-layer upper eyelashes, wherein each of the base-layer, second-layer, and third-layer artificial eyelashes has different lengths according to the base-layer, second-layer, and third-layer upper eyelashes.

* * * * *